United States Patent [19]

Etheredge, Jr.

[11] 3,965,760

[45] June 29, 1976

[54] OPERATING APPARATUS FOR SLIDING CLOSURES FOR RAILWAY CAR

[75] Inventor: Cortez Etheredge, Jr., Augusta, Ga.

[73] Assignee: Olin Corporation, New Haven, Conn.

[22] Filed: Nov. 27, 1974

[21] Appl. No.: 527,817

[52] U.S. Cl. ..... 74/89.14; 105/282 R

[51] Int. Cl.[2] ..... F16H 27/02

[58] Field of Search ..... 74/29, 89.14; 49/351; 105/307, 282

[56] References Cited

UNITED STATES PATENTS

| | | | |
|---|---|---|---|
| 3,183,852 | 5/1965 | Fritz | 105/282 R |
| 3,468,173 | 9/1969 | Fracke | 74/29 |
| 3,581,673 | 6/1971 | Danielson | 105/282 R |

*Primary Examiner*—Benjamin W. Wyche
*Assistant Examiner*—Wesley S. Ratliff, Jr.
*Attorney, Agent, or Firm*—James B. Haglind; Donald F. Clements; Thomas P. O'Day

[57] ABSTRACT

An improved apparatus is provided for operating the sliding closure of a railroad hopper car in which the hopper has a discharge opening at its lower end. The sliding closure or gate has a pair of arms attached to and extending from the closure, a gear attached to each of the arms and an opening in at least one of the gears. The improved turning means for the gears includes an adapter for insertion in the opening in the gear, a holding means for the adapter, a worm gear mounted on the holding means and a worm mounted on a worm shaft for engaging the worm gear and a means for driving the worm shaft is provided. A housing is provided for the worm gear and adapter holding means and the turning means can be readily removed after use.

The apparatus provides means for operating the closure without requiring manual force. The apparatus can be readily installed or removed and results in longer life for parts by reducing the frequency of replacement required.

4 Claims, 4 Drawing Figures

OPERATING APPARATUS FOR SLIDING CLOSURES FOR RAILWAY CAR

This invention relates generally to operating mechanisms for sliding closures. It particularly relates to an improved mechanism for operating a sliding closure such as a sliding gate covering an opening of a railway hopper car.

Railway freight cars which discharge the load through an opening in the bottom, generally known as hopper cars, have a sliding closure or gate which controls the size of the opening. While various mechanisms for moving the sliding closure on hopper cars are employed, certain hopper cars have a pair of gears mounted on a frame member each of which is attached to one end of a pivotal or flexible arm. The arms are attached at the other end to the sliding gate. Each of the gears has an opening or slot in which a bar or rod is inserted and manual force applied to turn the gears and slide open the gate. As the railway hopper cars are employed in handling salt, cement, lime and other materials which have a tendency to pack down while in transit, the exertion of great force is required to turn the gears and open the sliding gate. It is not surprising then that many accidents have occurred as a result of using manual force to pry open the sliding gate. In addition, gears have required frequent replacement as the force applied to each during the opening and closing of the gate has not been equal, resulting in undue wear.

It is therefore an object of the present invention to provide an apparatus for opening the sliding gate of a hopper car mechanically.

A further object of the present invention is an apparatus for operating the sliding gate of a hopper car which can be portably mounted.

These and other objects of the invention are accomplished in an apparatus for operating the sliding gate of a hopper car having a discharge opening at its lower end, a sliding gate for covering the opening, a pair of flexible arms attached to and extending from the sliding gate, a gate gear attached to each of the arms, with the gate gears intermeshing with one another, an opening in at least one of the gate gears, the improvement which comprises a turning means for the gears having at least one adapter for insertion in the opening in the gate gears, holding means for the adapter, a worm gear mounted on the holding means, a worm shaft, a worm mounted on the worm shaft for engaging the worm gear, a housing for the worm gear having openings for the holding means and the worm shaft and attachment means for the holding means and the worm shaft, and means for driving the worm shaft.

Accompanying FIGS. 1–4 illustrate the novel apparatus of the present invention. Corresponding parts have the same numbers in all Figures.

Figures 1, 2:
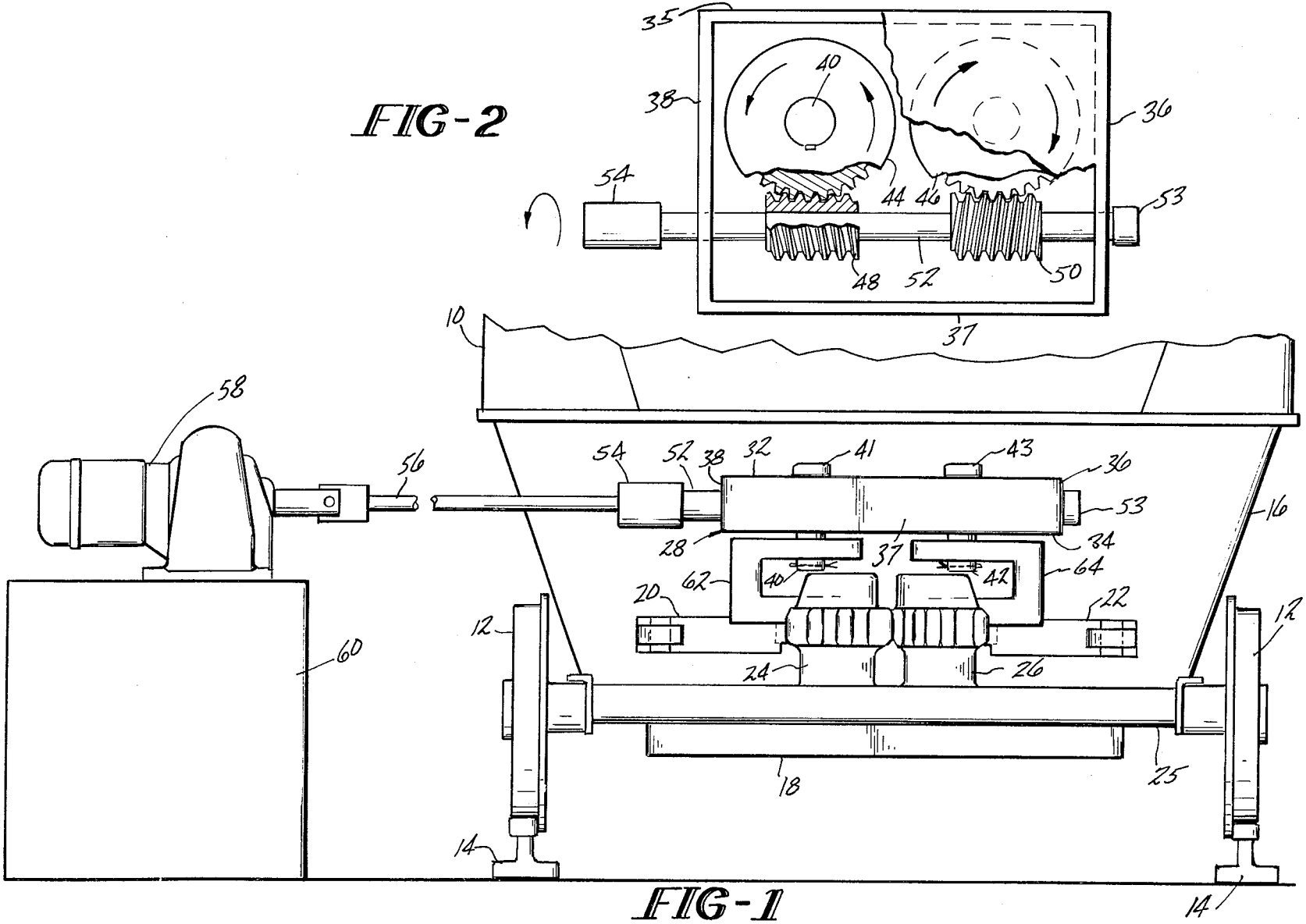
FIG. 1 represents an end view of a hopper car employing the gate operating apparatus of the present invention.
FIG. 2 illustrates a plan view of the housing for the gate operating apparatus of the present invention with the cover removed.

Freight car 10 having wheels 12 mounted on rails 14 has hopper 16 having an opening (not shown) for center discharge between rails 14. Sliding gate 18 controls the discharge of material and is slidably mounted on frame members (not shown) which border the lower portion of hopper 16.

Arms 20 and 22 are attached to sliding gate 18. Gears 24 and 26, mounted on frame member 25, are also attached to arms 20 and 22 respectively. The operating device 28 has a housing positioned above gears 24 and 26 comprised of top 32, bottom 34 and sides 35, 36, 37, and 38. Shafts 40 and 42, affixed to cover 32 by nuts 41 and 43, pass through openings (not shown) in bottom 34. Worm gears 44 and 46 attached to shafts 40 and 42, respectively, are engaged by worms 48 and 50 mounted on worm shaft 52. At one end, worm shaft 52 passes through an opening (not shown) in side 36, and is affixed to side 36 by nut 53. Coupling 54 is attached to the other end of worm shaft 52. Drive shaft 56 is connected to worm shaft 52 through coupling 54. Drive shaft 56 is driven by motor 58 mounted on platform 60.

Figure 3:
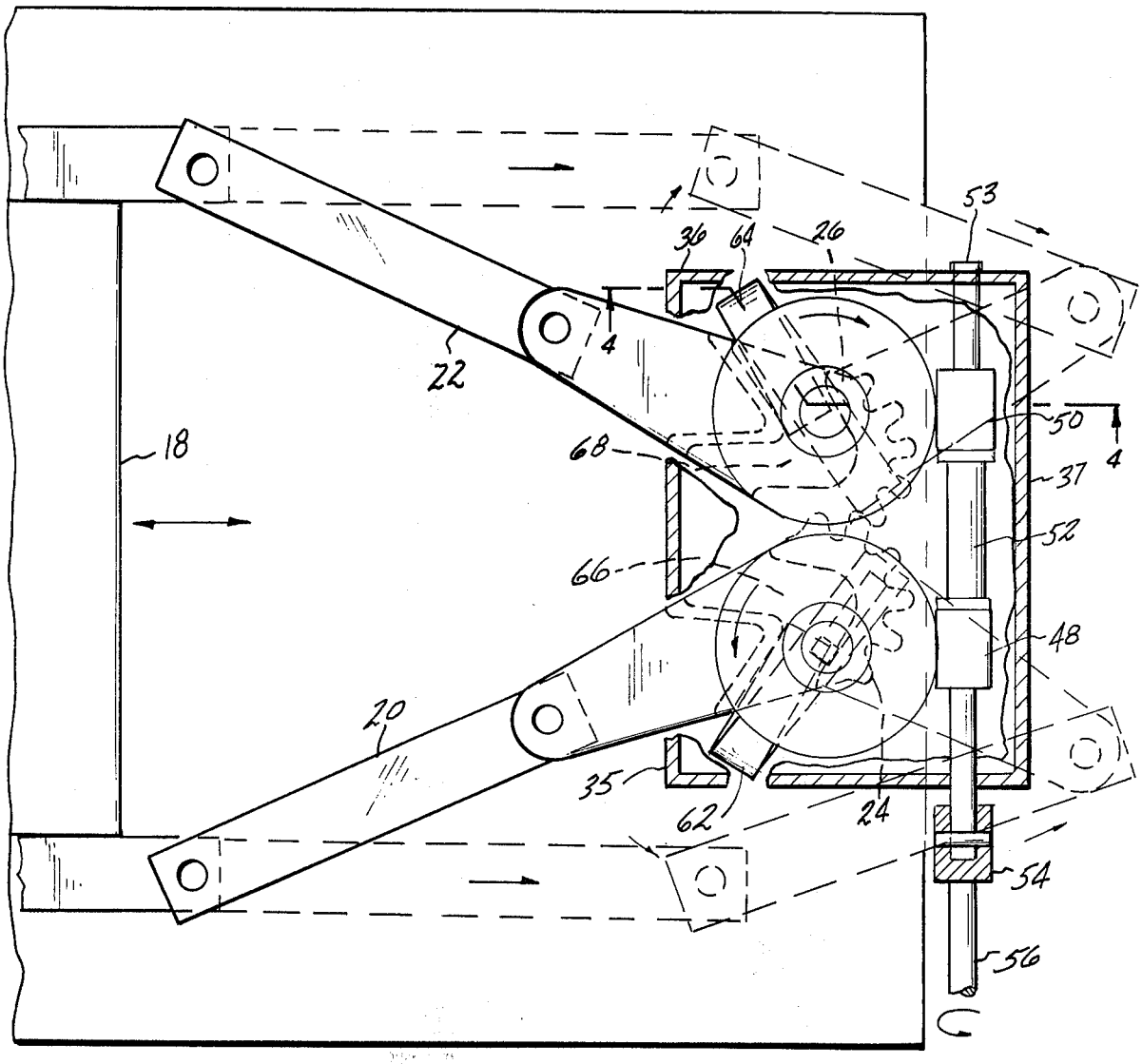
FIG. 3 is a plan view of the gate opening apparatus with the gate arms in opened and closed positions.
Figure 4:
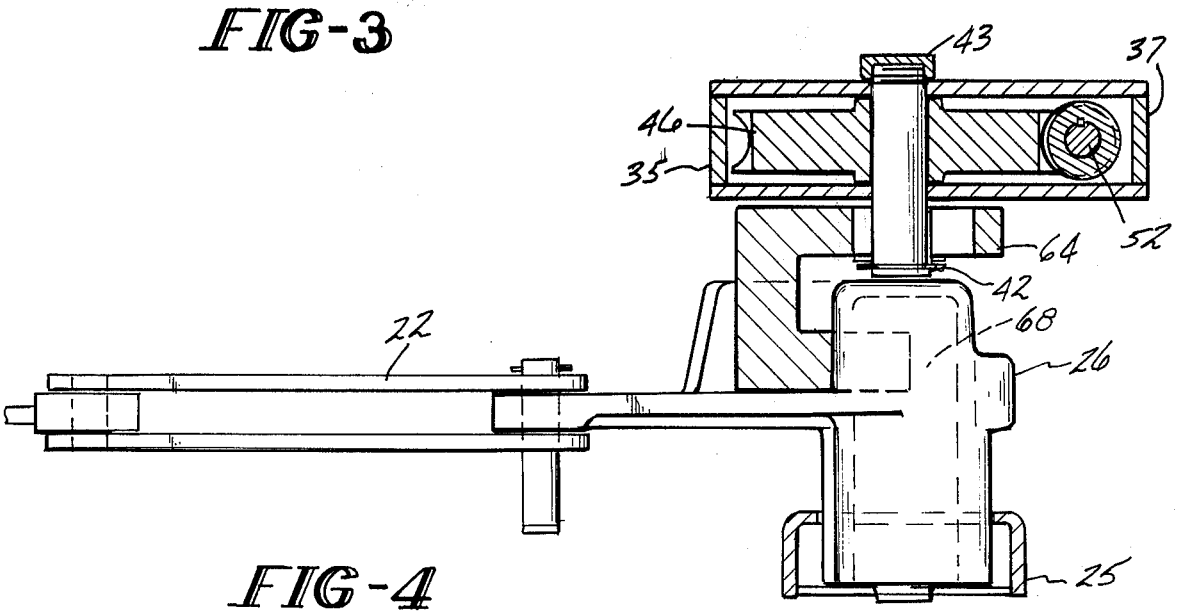
FIG. 4 represents a side elevation of the gate operating apparatus through lines 4—4 of FIG. 3.

Adapters 62 and 64, attached to shafts 40 and 42 respectively are inserted in V-shaped openings 66 and 68 of gears 24 and 26 (see FIG. 3). Upon turning drive shaft 56, worm shaft 52 turns and worm gears 44 and 46 rotate shafts 40 and 42 respectively. Adapters 62 and 64 inserted in openings 66 and 68 of gears 24 and 26, respectively, are turned by shafts 40 and 42 and gears 24 and 26 rotated. Attached arms 20 and 22 are flexed and sliding gate 18 is moved.

The gate operating apparatus of the present invention can be mounted permanently on the hopper car by attaching, for example, by welding, the holding means for the adapter to the upper side of the gears. However, as the hopper cars are frequently not owned by the recipients of the contents who have to unload the cars, the gate operating apparatus of the present invention is designed to be removable. The apparatus is temporarily installed by placing the housing on top of the car gears and is held in place by inserting the adapters in the gear openings.

The adapter is, for example, a C- or U-shaped piece with one arm of the adapter being inserted in the opening of the gear mounted on the hopper car frame. The other arm has an opening through which the holding means, for example, a shaft on which the worm gear is mounted, passes and the holding means is affixed, for example, by a pin or key. The opening in the arm of the adapter is sufficiently large to permit the adapter to be adjustably positioned with respect to the holding means.

While the gate opening apparatus of the present invention can operate using one adapter in combination with one worm gear, it is preferred to use two adapters and two worms gears to apply equal torque to each of the two gears attached to the gate arms.

At the end of the worm shaft is a coupling to which the driving means is attached. Any suitable type of driving means may be used, such as, for example, a telescoping assembly connected at one end to a motor and at the other end to the coupling on the worm shaft.

The housing for the gate operating apparatus of the present invention is, for example, a rectangular box having a cover, a bottom and front, back and lateral walls. The cover and bottom have corresponding openings through which the adapter holding means passes. The adapter holding means is affixed to the cover by, for example, a nut or a pin or key passing through a hole in the holding means. The sides have corresponding openings for the worm shaft which is affixed to one side in a manner similar to that of the adapter holder means.

The gate opening apparatus provides for the opening and closing of the sliding gate without requiring manual force. It also provides the advantages of ease of installation and results in longer life for parts by reducing the frequency of replacement required.

What is claimed is:

1. In an apparatus for operating the sliding gate of a hopper car having a discharge opening at its lower end, a sliding gate covering said opening, a pair of flexible arms attached to and extending from said sliding gate, a gate gear attached to each of said arms, said gate gears intermeshing with one another, an opening in at least one of said gears, the improvement which comprises a turning means for said gate gears having at least one adapter for insertion in said opening in said gate gears, holding means for said adapter, a worm gear mounted on said holding means, a worm shaft, a worm mounted on said worm shaft for engaging said worm gear, a housing for said worm gear, said housing having openings for said holding means and said worm shaft and attachment means for said holding means and said worm shaft, and means for driving said worm shaft.

2. The apparatus of claim 1 wherein said turning means is removably mounted on said gate gears.

3. The apparatus of claim 1 wherein said adapter is C shaped and is adjustably attached to said holding means.

4. The apparatus of claim 3 wherein said holding means is a shaft.

* * * * *

PO-1050
(5/69)

UNITED STATES PATENT OFFICE
CERTIFICATE OF CORRECTION

Patent No. 3,965,760 Dated June 29, 1976

Inventor(s) Cortez Etheredge, Jr.

It is certified that error appears in the above-identified patent and that said Letters Patent are hereby corrected as shown below:

In the title on the front page, after "CAR" insert --HOPPERS--.

Column 1, in the title, after "CAR" insert --HOPPERS--.

Signed and Sealed this

Eighth Day of February 1977

[SEAL]

*Attest:*

RUTH C. MASON
*Attesting Officer*

C. MARSHALL DANN
*Commissioner of Patents and Trademarks*